US007150081B2

(12) United States Patent
Juan

(10) Patent No.: US 7,150,081 B2
(45) Date of Patent: Dec. 19, 2006

(54) DEVICE FOR JOINING CLOTHING ITEMS AND TEXTILE ITEM INCLUDING SAID DEVICE

(75) Inventor: Sergio Nolla Juan, Barcelona (ES)

(73) Assignee: Industrias Sinteticas Catalanas, S.L., Barcelona (ES)

( * ) Notice: Subject to any disclaimer, the term of this patent is extended or adjusted under 35 U.S.C. 154(b) by 0 days.

(21) Appl. No.: 11/300,730

(22) Filed: Dec. 14, 2005

(65) Prior Publication Data

US 2006/0123606 A1 Jun. 15, 2006

Related U.S. Application Data

(63) Continuation of application No. PCT/ES2005/000664, filed on Dec. 5, 2005.

(30) Foreign Application Priority Data

Dec. 14, 2004 (ES) ..... 200402965

(51) Int. Cl.
*A41B 11/00* (2006.01)
*A44B 1/08* (2006.01)
*A44B 17/00* (2006.01)

(52) U.S. Cl. ..... 24/584.1; 24/586.11; 24/104; 2/239

(58) Field of Classification Search ..... 24/584.1, 24/DIG. 29, DIG. 38, 104, 114.4, 114.05, 24/586.11
See application file for complete search history.

(56) References Cited

U.S. PATENT DOCUMENTS 4,344,240 A * 8/1982 Schiller ..... 24/114.05
4,982,480 A * 1/1991 Kasai ..... 24/104
5,038,413 A * 8/1991 Ursino ..... 24/DIG. 29
5,357,660 A * 10/1994 Smith ..... 24/DIG. 29
5,440,791 A 8/1995 Guio
5,450,658 A * 9/1995 Hicks ..... 24/DIG. 29
5,490,309 A * 2/1996 Velasquez et al. ..... 24/90.1
5,974,590 A * 11/1999 Stubbs ..... 24/DIG. 29
6,032,294 A * 3/2000 Dean ..... 2/239
6,233,782 B1 * 5/2001 Regele et al. ..... 24/584.1

FOREIGN PATENT DOCUMENTS

| | | |
|---|---|---|
| ES | 1 033 211 | 2/1996 |
| ES | 1 051 475 | 11/2001 |
| ES | 1 052 658 | 8/2002 |
| GB | 2043 158 A | 10/1980 |

* cited by examiner

*Primary Examiner*—Robert J. Sandy
(74) *Attorney, Agent, or Firm*—Knobbe Martens Olson & Bear LLP

(57) ABSTRACT

A device for joining sets of two or more clothing items, such as socks, gloves or the like, comprises at least two identical components (1, 1') that can be coupled to each other, as well as a textile item including entire sets of underwear, home linen etc. that incorporates the device for pairing the items when they are washed, dried or stored, preventing having to search for the correct paid of each item before using them. Each of the components (1, 1') is in turn divided into an outer part (2, 2') and an inner part (3, 3') that are also coupled to each other by inserting ribs (5, 5') provided on the inner face of the outer part (2, 2') in the orifice (4, 4') made in the centre of the inner part (3, 3') so that they are secured in them; the outer, smooth face can bear advertising symbols.

6 Claims, 8 Drawing Sheets

(A)

(B)

(C)

(A)

(B)

(C)

(A)

(B)

(A)

(B)

DEVICE FOR JOINING CLOTHING ITEMS AND TEXTILE ITEM INCLUDING SAID DEVICE

CROSS-REFERENCE TO RELATED APPLICATIONS

This application is a continuation of PCT Application No. PCT/ES2005/000664 filed Dec. 5, 2005.

OBJECT OF THE INVENTION

The present invention is applicable in the textile industry sector, specifically in the manufacture of clothing complements of the type usually formed by two or more equivalent units, such as socks, booties, stockings, leg warmers, gloves, mittens, oversleeves, slippers, etc., as well as complete sets of underwear comprising a bra and panties, or other matching items, such as briefs with a T-shirt and socks, etc.

The invention disclosed relates to a device which, conceived in shape and size to be incorporated in the aforementioned type of clothing items, allows joining an item with its corresponding pair and, in general, one textile item to another.

Another aspect of the invention is a textile item, essentially a clothing complement consisting of a pair of equivalent items, distinguishable only in that each one corresponds to one side of the user's body, hand, arm, foot, etc., or fully interchangeable by being completely identical, which includes the aforementioned joining device.

Similarly, the textile item incorporating the joining device of the invention also relates to home linen, such as tablecloths, towel sets, bedding, etc.

A main object of the invention is to facilitate the attachment of items forming pairs or sets when they are not being used and must be washed, dried or stored, in order to save time and trouble by not having to pair them again before they are used.

Another object of the invention is to allow an additional identification of the items, including symbols identifying their user or the manufacture or distributor, on the joining device incorporated in the pairs of clothing items and textile items.

BACKGROUND OF THE INVENTION

A daily problem suffered by most people when getting dressed is that certain items, such as socks, gloves and other items used in pairs, must be correctly paired in order to avoid the hurry of modern life or our absent-mindedness leading to our wearing different coloured socks or only one glove after failing to find the other.

When a person takes off their socks, stockings, gloves, etc. intending to wash them or put them away, each item will be separated, the washing machine separating them even more. It is therefore quite bothersome to find the pair of each item before placing them on the clothesline to dry or, later when storing them, to leave them so that they can be used immediately when desired.

It is even more bothersome when several persons, such as the various members of a family, use the same washing machine simultaneously and moreover own very similar clothing items, especially stockings and socks. In the end, their confusion leads to undesired exchanges.

To prevent these potentially comical or embarrassing situations from happening there are clips or other device in the market that are used to hold together socks, gloves and the like, mainly meant to be used when washing and laying them to dry.

One example is the pin for attaching socks, stockings or gloves of Spanish Utility Model ES 1051475 U, which on its ends has a clip closure system and numerous ventilation openings to allow washing and drying the items.

Another device for hanging paired items is described in Spanish Utility Model ES 1052658 U, which adopts a spindle-like configuration to form a flexible plastic pin which incorporates on either side membranes obtained by radial cuts, in which the items are introduced and attached without being damaged due to the flexibility of the membranes that retain each textile item of the pair.

The disadvantage of these devices is that there are in turn loose, independent of the clothing items they hold together, so that they must be attached when washing or laying the clothes to dry in order to have the items paired, but must later be removed in order to store or wear the item. This saves time when washing or laying to dry the items joined in pairs, but time is lost by having to search for the correct pin.

DESCRIPTION OF THE INVENTION

The present invention solves, among others, the disadvantages described above in a fully satisfactory manner in each and every aspect discussed.

The invention described herein relates to a device for joining clothing items, which consists of at least two components, each one incorporated in one of the items forming a set, such as a bra and panties or briefs, T-shirt and socks, or those formed by pairs such as stockings, gloves and the like.

The components of the joining device have an identical configuration, each one constituted by two locking parts, so that each component of the joining device is attached to one item of the air, which is thus clasped between the two corresponding parts.

For each component, one of the parts will be on the outside of the sock, glove or item to be joined, so that it can be used to incorporate a mark or distinctive symbol that helps users their items, such as by bearing their initials. Similarly, the manufacturers, distributors or final vendors of these items can add their logo, brand name or any other advertising mark.

With this purpose, among others described further below, the outer part of each component of the device described has a smooth face, while the opposite face has a continuous rib or one formed by several ribs with an external toothing to snap onto the other part, inside the item being held.

This rib toothing used to couple the outer part to the other part of the same component may have several configurations, with more or fewer teeth, in order to allow attachment to items of a different thickness, ranging from silk stockings or nylon socks to thick woollen gloves.

To snap together the two parts of a component of the device for joining socks and the like, the part that is inside the item has a hollow area, preferably centred, that defines an opening with a shape and dimensions suited for coupling to the ribs and toothing of the outer part.

The outer part has its ribs on the suitable position of the face that touches the item, in order to trap the latter in between when it is coupled in the opening of the other part of the component that is holds said item. In turn, it has another corresponding pair in which the other components of the device for joining the pairs of items is identically fitted.

When washing, drying or storing the pair of items together, the two components of the device of the invention are joined, as they can also be coupled to each other.

Coupling of the two components to join a pair of items is obtained by the configuration of the two parts of said components.

Preferably, each part is disc-shaped. The inner part has a continuous or discontinuous lip on its entire perimeter, on the inner hollow area, this is, the area opposite that on which the outer part of the same component snaps on, which is directly or indirectly in contact with the skin of the user and is exposed to the air when the item is not in use.

The circular contour of the outer part of one component therefore snaps on the hollow space of the inner part of the other component of the joining device, while the wedge-shaped lips of the latter part retain the first part, so that the two components of the device are efficiently coupled to allow holding together the two items while they are washed, dried or even while stored in drawers or shelves, either at home or in a retail establishment.

Thus, the wedge-shaped lips of the inner part, together with the shape of the contour of the outer part, allow the user to join the two components and thereby to join the two items to which they are attached, in a convenient manner by applying a slight pressure to insert on piece in the other, as well as to separate them easily without effort, as the wedge and the disc are coupled as a simple clip.

Another aspect of the invention relates to a textile item including a joining device, generally constituted by two components, which may be identical or different, each one attached to the textile units that form the complete item, such as a set of tablecloths, towels, sheets, underwear, etc. The two components of the device are adapted in shape and dimensions to be fitted in one another.

The textile item incorporating a joining device as described above does not only relate to clothing items or items of the type generally comprised of a group of equivalent units, distinguishable only in that each unit corresponds to one side of the user's body, hand, arm, foot, etc. or are fully interchangeable as they are identical, but also to other home linen items such as bedding, towels, tablecloths, napkins, sheets, pillowcases, bikinis, etc.

Belonging to this group are the aforementioned examples, such as socks, stockings or gloves, including mittens, leg warmers and oversleeves, currently fashionable among the young, or booties used mainly by babies and the elderly.

In addition, the joining device conceived to solve the problem of pairing items immediately can be applied to other clothing items such as textile slippers used in classical dance or those used for comfort at home, in the countryside, on the beach, etc.

Other applications of the invention are to join the items of an underwear set or a bikini, a bra to the panties, etc., or the textile units of a tablecloth set, the tablecloth to the napkins, or any textile item comprised by a group of two or more units.

Therefore, an improvement in relation to the known device for these and related purposes is that the device disclosed in not separate from the item, but is instead incorporated in a simple manner by coupling the two parts of one of the components, in a snap-on manner, so that the item is held between them.

The attachment of the joining device to the items can be optionally secured by adhesives or by sewing at least one of the parts, as well as by other traditional techniques.

In this way there is no risk of losing the parts, and it is not necessary to attach them each time the items are washed, not is it necessary to remove them after they are washed and dried to store them; the user can even wear the items with the parts suitably attached, the items separately including one component of device of the invention.

Another advantage with respect to the known art is the added value provided to the object of the invention, as a trade mark can be included on one face of the outer part of each component. Their smooth outer surface allows incorporating not only logos of the manufacturers or vendors, but also symbols to identify the owner of the items in order to distinguish them from other similar items, or such as in the case of child's clothing to differentiate the left and right items.

The parts used are small and have rounded edges to avoid bothering the user when they contact the skin, being pleasant to the touch and aesthetically pleasing as an accessory on the item, with suitable colours or figures, mainly advertising marks.

The components and parts are made of materials that will survive the entire washing and drying process, withstanding the high temperatures reached in the machines used for such purpose, as well as the detergents, softeners and water without being harmed. The round shape of the ribs, lips and toothings of the items will not damage the items they are attached to, some of which can be delicate, such as fine stockings. Another property is that the smooth face of the parts may be printed by serigraphy or bear marks made by other means, such as by engraving letters or other signs on the material.

The device is preferably made of plastic, although other materials commonly used in the textile industry and in manufacturing ornaments may also be used, such as stainless metals, to increase the sturdiness of the components, or silver to add economic value to the final product to constitute an original gift along with the clothing item.

DESCRIPTION OF THE DRAWINGS

To complete the description being made and in order to aid a better understanding of the characteristics of the invention, a set of drawings in incorporated forming an integral part of this Patent where, for purposes of illustration and in a non-limiting sense various preferred embodiments of the invention are shown as follows.

PREFERRED EMBODIMENT OF THE INVENTION

Figure 1:
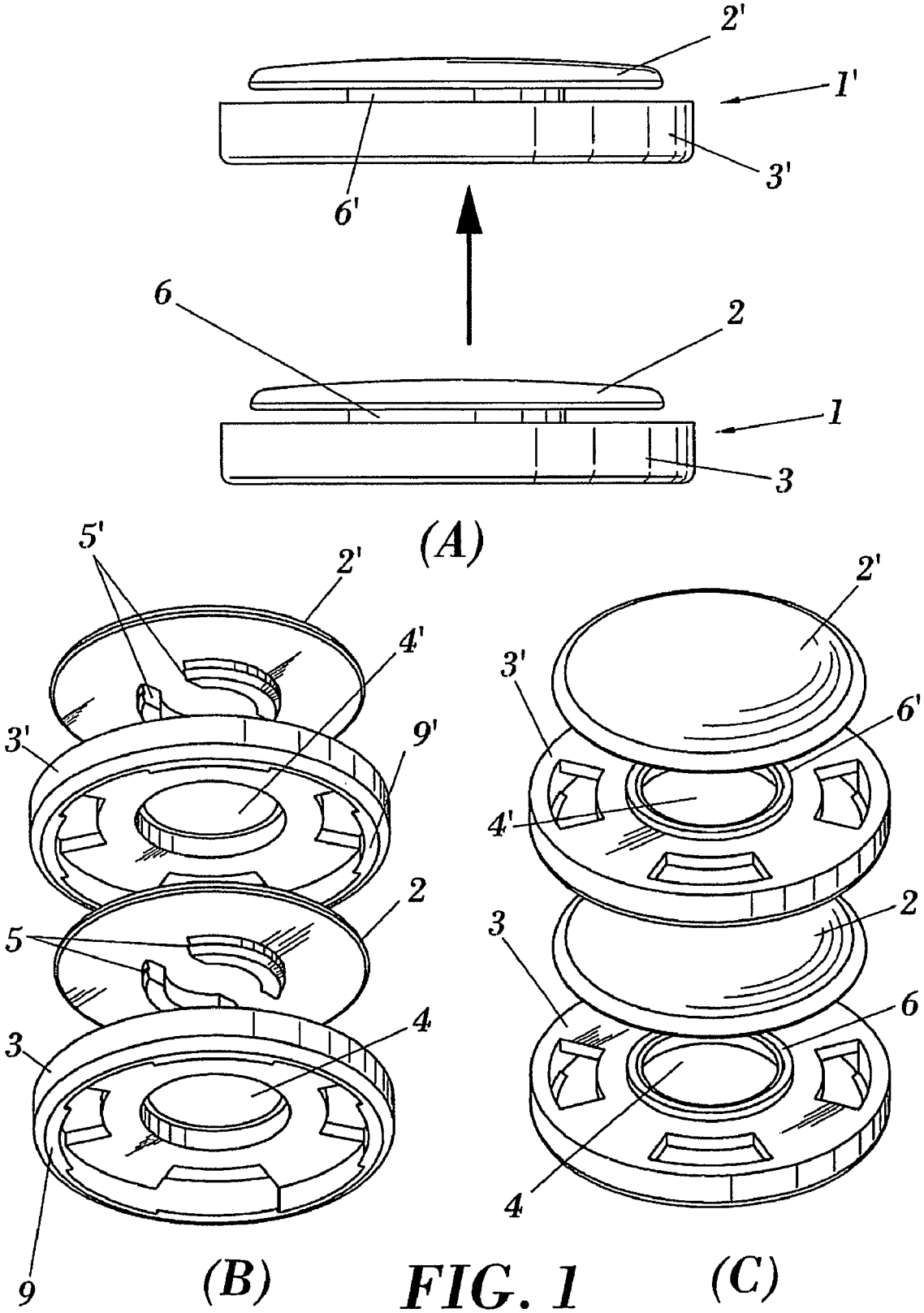
FIG. 1A shows an elevation view of the two components that form the device, identical and attachable according to the object of the invention to join pairs of items.
FIG. 1B shows a perspective view from below of said two components of the previous figure, separated into their two parts, inner and outer, according to a preferred embodiment of the device of the invention.
FIG. 1C shows a perspective view from above of said two components of the previous figure, separated into their two parts, inner and outer, according to a preferred embodiment of the device of the invention.

In view of the drawings described above, one can describe as a possible embodiment of the invention a device for joining clothing items that comprises at least two identical components (1, 1') that can be coupled to each other, as shown in FIG. 1A.

Each component (1, 1') is in turn divided into an outer part (2, 2') and an inner part (3, 3') that are also coupled to each other by inserting the ribs (5, 5') provided on the inner face of the outer part (2, 2') as shown in FIG. 1B, in an orifice (4, 4') made in the centre of the inner part (3, 3'), so that they are perfectly inserted in one another as shown in FIG. 1A.

Figure 2:
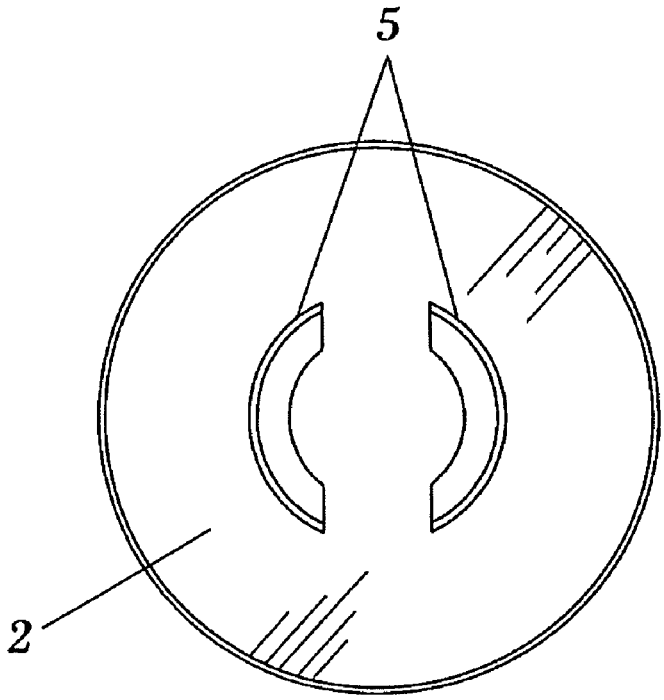
FIG. 2A shows a plan view of the inner face of an outer part of one of the components of the device for joining clothing items showing the ribs with which it snaps in the inner part of the same component, according to a preferred embodiment of the invention.
FIG. 2B shows an elevation view of the outer part of one of the components of the device for joining clothing items showing the ribs and the toothing by which it retains the clothing item, according to a preferred embodiment of the invention.
FIG. 2C shows an elevation and enlarged view of the toothing that determines the outer contour of the ribs of said outer part of the previous figure, according to a preferred embodiment of the invention.
Figure 2:
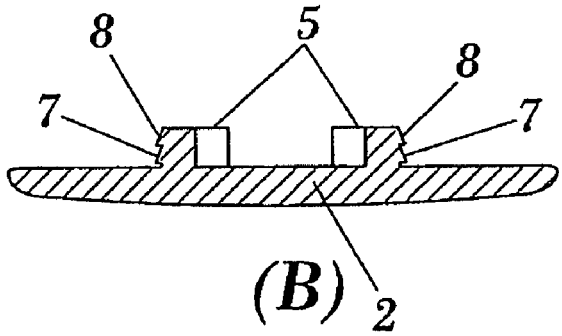
Figure 2:
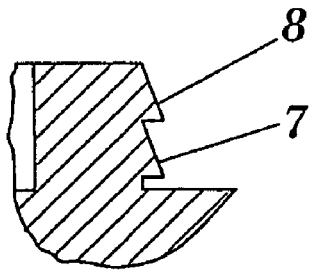

Said central orifice (4, 4') of each inner part (3, 3') has a peripheral flange (6, 6') as shown in FIG. 1C, whose shape is adapted to the contour of the ribs (5, 5'), preferably circular and discontinuous as represented in FIG. 2A, where a toothing is provided externally configured with at least one lower tooth (7) to retain fine items and at least one upper tooth (8) for thick items, shown in FIG. 2B and in greater detail in FIG. 2C.

Figure 3:
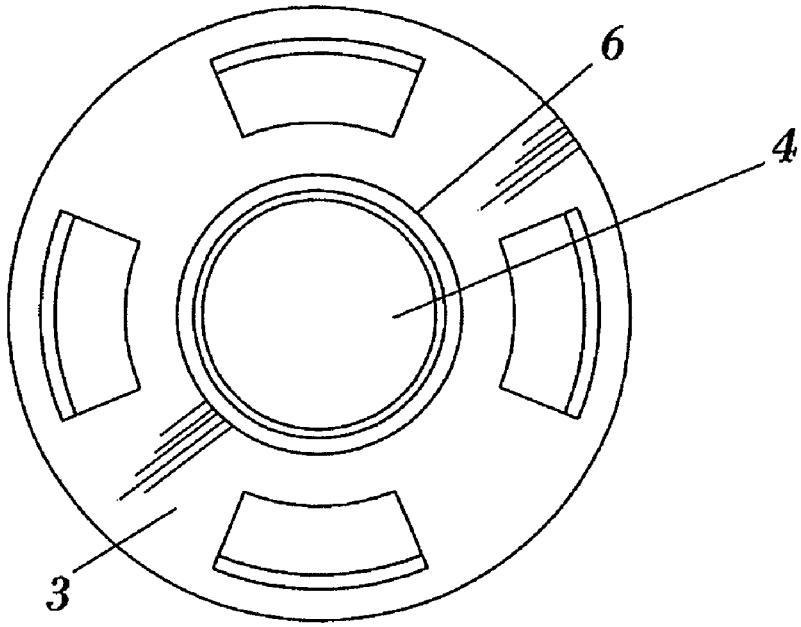
FIG. 3A shows a plan view of the upper face of the inner part of one of the components of the device for joining clothing items, showing the central orifice in which are inserted the ribs of the outer part of the same component, according to a preferred embodiment of the invention.
FIG. 3B shows an elevation view of the inner part of one of the components of the device for joining clothing items, showing the wedge-shaped lips on the bottom of said outer part of the previous figure, according to a preferred embodiment of the invention.
FIG. 3C shows an elevation and enlarged view of the wedge shape of the lips of said inner part of the previous figure, according to a preferred embodiment of the device of the invention.
Figure 3:
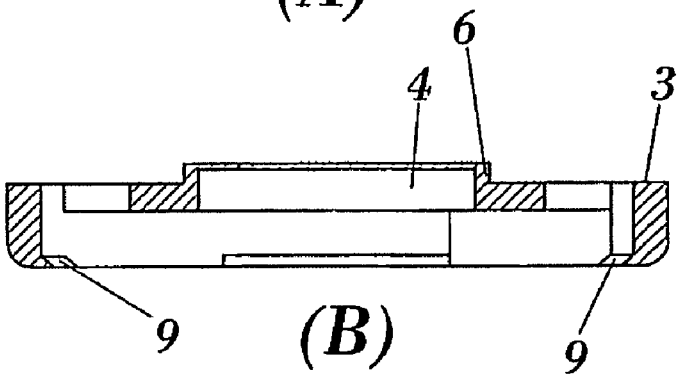
Figure 3:
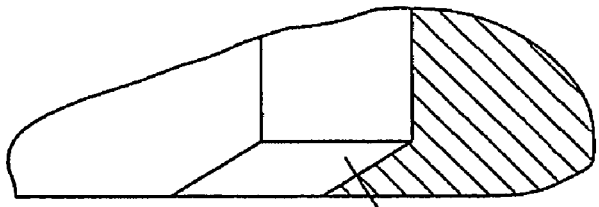

On the bottom part of said inner part (3, 3') opposite that shown in FIG. 3A, for each of the components (1, 1') of the joining device, are incorporated wedge shaped lips (9, 9') as shown in FIG. 3B and in detail in FIG. 3C.

Figure 4:
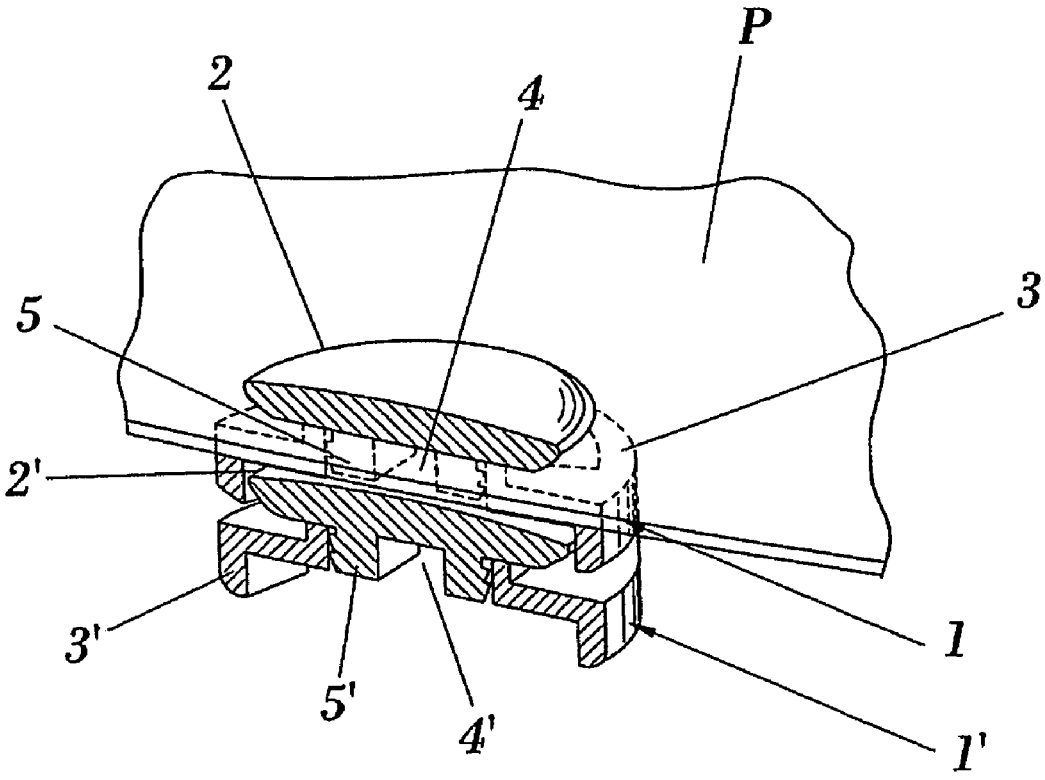
FIG. 4 shows a perspective and sectional view of the two parts of each component inserted in each other and the two components of the device attached.

Said ribs (9, 9') of the inner part (3, 3') in accordance with the shape of the contour of the outer part (2, 2') facilitate coupling the two components (1, 1'). To join one component (1) to the other component (1') of the device of the invention, the outer and smooth face of the outer part (2) of the first component (1) is inserted by manual pressure in the hollow lower part of the inner part (3') of the second component (1'), leaving them perfectly coupled as shown in FIG. 4.

Figure 5:
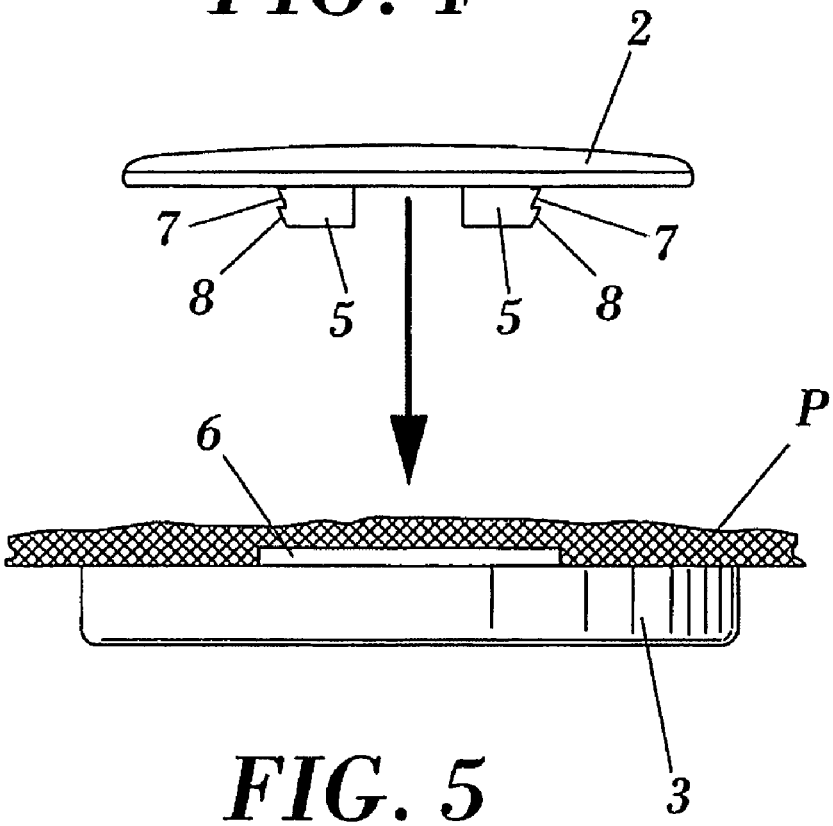
FIG. 5 shows an elevation view of the outer and inner parts of a component before they are coupled to be attached to a clothing item.
Figure 6:
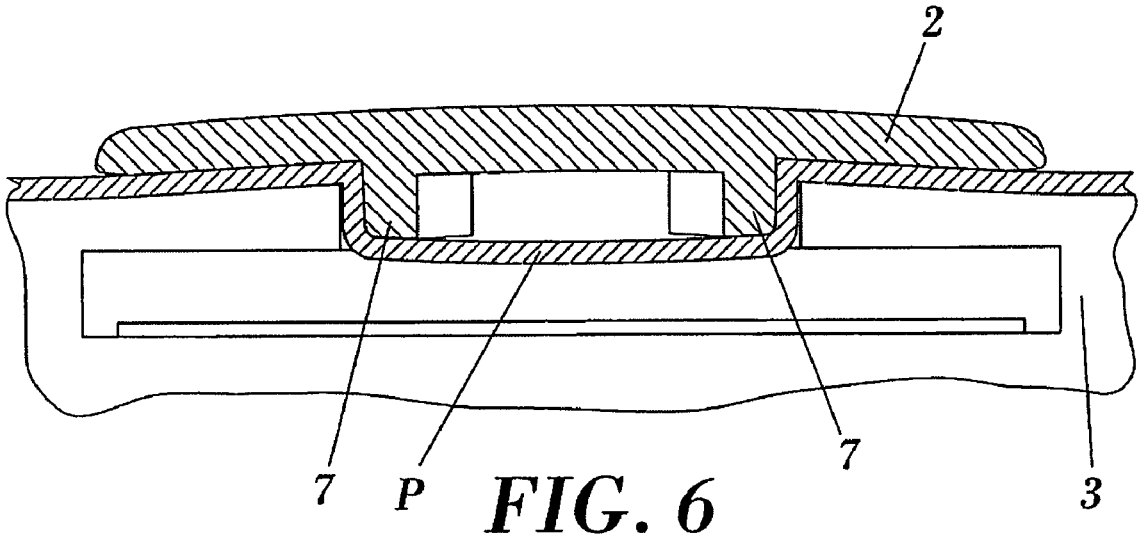
FIG. 6 shows a cross section of a component with the two inner and outer parts coupled to each other, trapping a small part of the clothing item.
Figure 7:
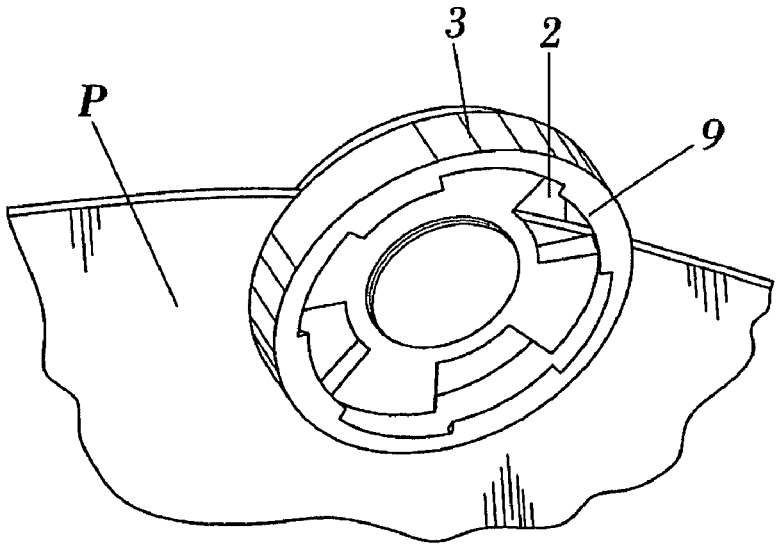
FIG. 7 shows a perspective view of a component with the two inner and outer parts coupled to each other, trapping a small part of the clothing item.

To attach a component (1) to an item (P), the outer part (2) and inner part (3) are coupled as shown in FIG. 5 by placing the item (P) between them. Said item is thereby retained by the perfect couple between the ribs (5) of the outer part (2) in the orifice (4) of the inner part (3) of the same component (1), as shown in FIGS. 6 and 7.

Figure 8:
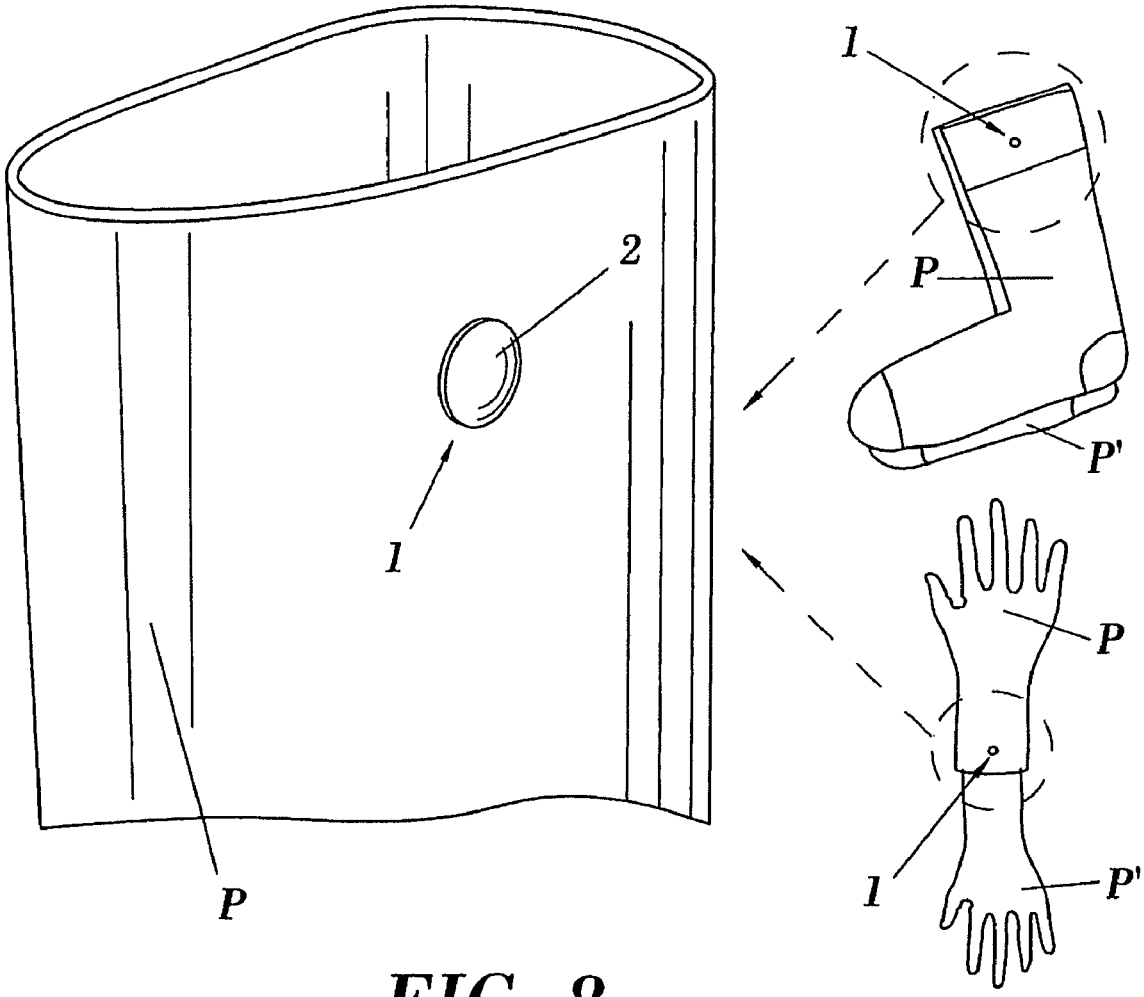
FIG. 8 shows clothing complements such as socks or gloves including the components of the device for joining pairs of clothing items.

The component (1) of the joining device incorporated to the item (P), which may be a sock, stockings, a glove, etc. in general paired with another identical item (P'), in this preferred embodiment, has the appearance of a tiny button, as represented in FIG. 8.

The outer part (2) is configured in a disc shape, with a diameter slightly smaller than that of the inner part (3) in which it is inserted, which has a similar circular button configuration. On the outside, said outer part (2) has a smooth surface where it is possible to print or draw letters and identification symbols, advertising symbols or symbols that identify the owner of the item (P).

The component (1), thus attached to the item (P), will last its entire lifetime as well as withstanding the normal washing and drying processes to which said item (P) is subjected by the user. One option to ensure an even more secure attachment of the component (1) to the item (P) is to sew its inner part (3) inside said item (P).

Figure 9:
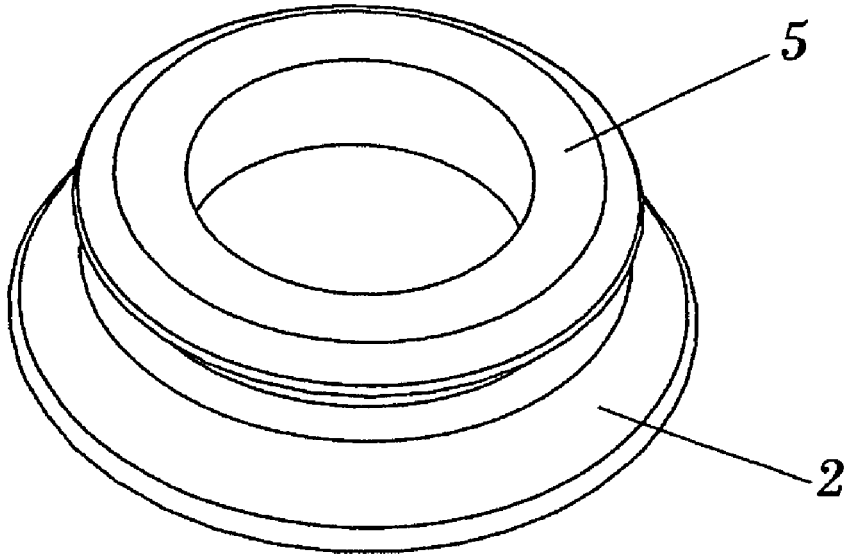
FIG. 9A shows a perspective view of the inner face of the outer part of one of the components of the device for joining clothing items, showing the continuous rib with which it locks in the inner part of the same component, according to another preferred embodiment of the invention.
FIG. 9B shows a perspective view of the inner face of the outer part, according to the embodiment represented in the previous figure.
Figure 9:
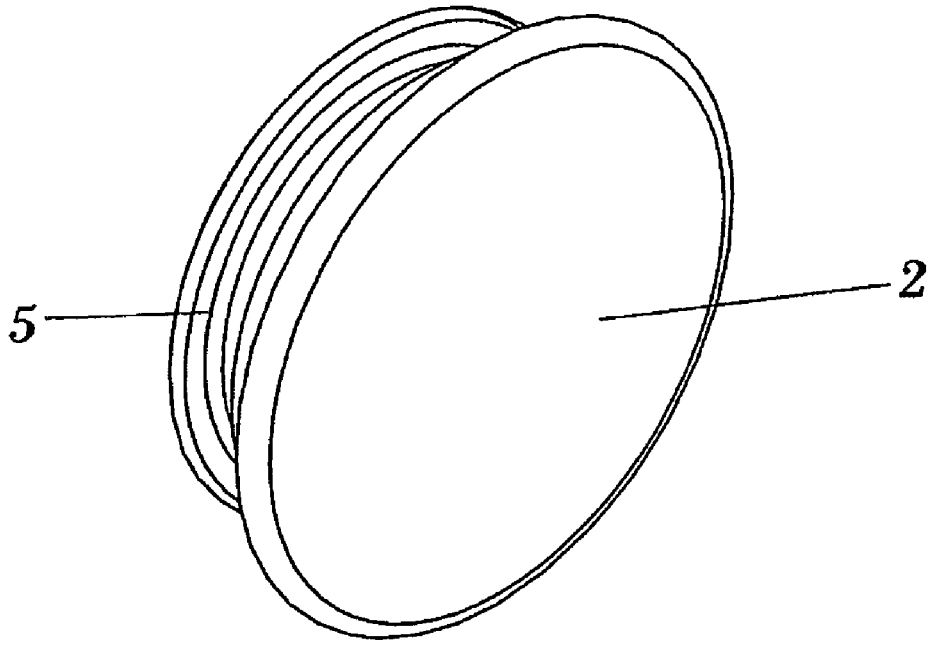
Figure 10:
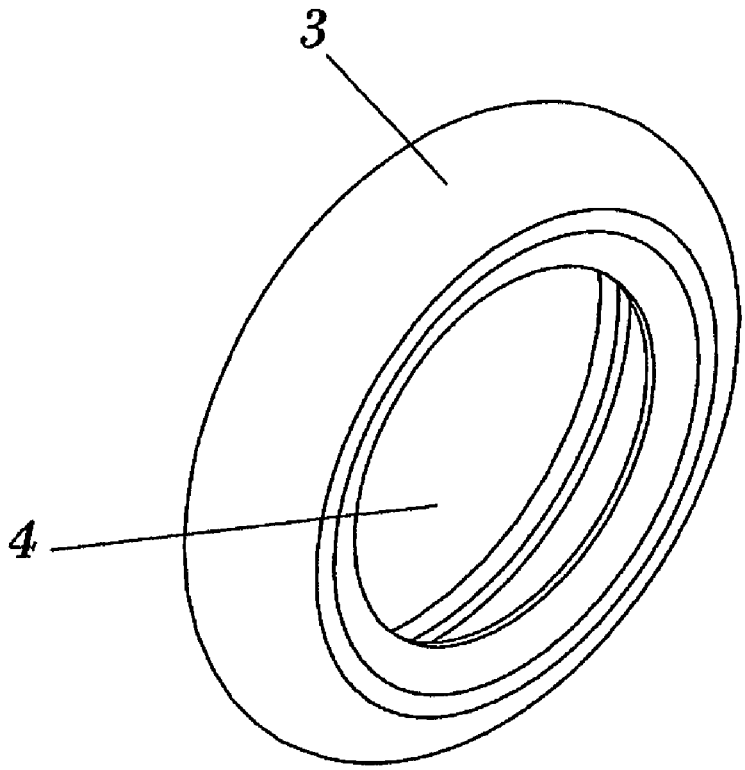
FIG. 10A shows a perspective view of the top face of the inner part of one of the components of the device for joining clothing items, showing the central orifice in which is inserted the rib of the outer part of the same component, corresponding to the embodiment of the invention shown in the enlargements A and B of FIG. 9.
FIG. 10B shows a perspective view of the inner face of the inner part, according to the same embodiment represented in the previous figure.
Figure 10:
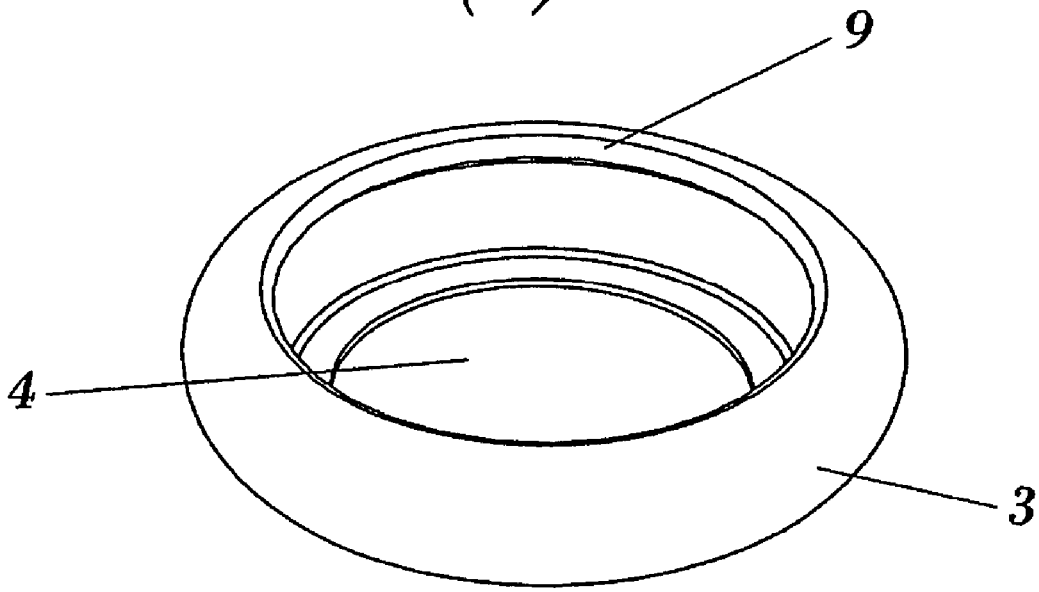

Another alternative embodiment of the parts (2, 3) is that represented respectively in FIGS. 9 and 10. As shown in the enlargements A and B of FIG. 9, the rib (5) of the outer part (2) is continuous in this case, forming a full circle. To this outer part (2) corresponds an inner part (3) made as shown in FIG. 10, being provided with an orifice (4) adapted to the diameter of the rib (5) that must be coupled inside it. This other inner part (3) has an also continuous lip (9) on its entire perimeter, in accordance with the shape of the contour of the outer part (2) to allow coupling like components (1, 1'). The latter configuration considerably improves the effectiveness of the invention and simplifies its manufacturing process.

The small dimensions of all the parts (2, 3) do not interfere with the washing or drying of the item (P) in which they are incorporated, as well as not affecting the appearance or comfort of use of the item.

The joining device is made of plastic with a structure that allows attaching a pair of clothing items or slippers, not too thick, with great effectiveness, in a simple manner and without requiring the user to look for a device foreign to the items, as each component constituting the proposed device is included in both items or units of the pair to be used.

The invention claimed is:

1. A device for joining clothing items, such as underwear, socks, gloves and the like, comprising at least two components with a shape and size allowing them to be coupled, wherein said components that can be coupled are identical and each one comprises a pair of parts between which each item is held, placing one part outside the item and another part inside said item, and wherein said components are configured so that a component associated with one item is coupled to another component that is associated with another item, when the outer part of a component is inserted in the inner part of the other component to join at least two items, and wherein said inner part has a bottom part which is hollow and is provided internally on its contour with wedge-shaped lips that allow coupling said inner part with a face on the outside of the item of the outer part of the other component.

2. The device for joining clothing items according to claim 1, wherein the face on the outside of the item of the outer part of each component is smooth in order to include publicity or other distinctive symbols.

3. The device for joining clothing items according to claim 1, wherein the outer part of each component incorporates ribs on its inner face and the inner part has an orifice where said ribs are inserted to associate said component to an item that is placed between the ribs and the orifice.

4. The device for joining clothing items according to claim 3, wherein said ribs of the outer part of each component are provided on their outer contour with a toothing having at least one bottom tooth to retain fine items and at least one upper tooth for thick items.

5. A textile item of the type constituted by a set of units, wherein each of said units includes a component of the device for joining items defined according to claim 1.

6. The textile item according to claim 5, wherein said textile item is selected among a set of underwear, a set of tablecloths, a set of towels, sheets, socks, stockings, leg warmers, booties, gloves, mittens, oversleeves and slippers.

* * * * *